US009741320B2

(12) United States Patent
Stromberg

(10) Patent No.: US 9,741,320 B2
(45) Date of Patent: Aug. 22, 2017

(54) VIBRATION DAMPENING DEVICE AND A CLOSED CHAMBER DEFLECTABLE ACCESSORY FOR A VIBRATION DAMPENING DEVICE

(71) Applicant: Peter Stromberg, Simsbury, CT (US)

(72) Inventor: Peter Stromberg, Simsbury, CT (US)

( * ) Notice: Subject to any disclaimer, the term of this patent is extended or adjusted under 35 U.S.C. 154(b) by 197 days.

(21) Appl. No.: 14/359,361

(22) PCT Filed: Nov. 19, 2012

(86) PCT No.: PCT/US2012/000559
§ 371 (c)(1),
(2) Date: Dec. 17, 2015

(87) PCT Pub. No.: WO2013/077894
PCT Pub. Date: May 30, 2013

(65) Prior Publication Data

US 2016/0155431 A1 Jun. 2, 2016

Related U.S. Application Data

(60) Provisional application No. 61/562,546, filed on Nov. 22, 2011, provisional application No. 61/562,585, filed on Nov. 22, 2011.

(51) Int. Cl.
*G10D 3/04* (2006.01)

(52) U.S. Cl.
CPC ..... *G10D 3/043* (2013.01)

(58) Field of Classification Search
None
See application file for complete search history.

(56) References Cited

U.S. PATENT DOCUMENTS

| | | | | |
|---|---|---|---|---|
| 4,793,234 | A * | 12/1988 | Geis | G10D 3/043 84/318 |
| 8,269,084 | B2 * | 9/2012 | Ludwig | G10D 3/043 84/315 |
| 9,035,161 | B2 * | 5/2015 | Campling | G10D 3/043 84/318 |
| 2016/0155431 | A1 * | 6/2016 | Stromberg | G10D 3/043 84/318 |

* cited by examiner

*Primary Examiner* — Robert W Horn
(74) *Attorney, Agent, or Firm* — McCormick, Paulding & Huber

(57) ABSTRACT

A capo for a stringed musical instrument is clamped on the neck of the instrument and has a flexible portion that is pressed against the strings between frets to change the tone of the instrument. The flexible portion may comprise various materials including a vessel wall structure filled with a fluid. Also, the flexible portion may comprise a silicone rubber.

20 Claims, 16 Drawing Sheets

Figure 10

Shore Durometer Hardness

The Shore Durometer hardness is a dimension-less number and measures indentation, using different type of bodies penetrating the material. The type of indenter has to be specified.

The table below presents values using the type A indenter and measured according to ASTM D2240.

| Material | Shore Durometer Hardness |
|---|---|
| Rubber Band | 25 |
| Door Seal | 55 |
| Automotive Tire Tread | 70 |
| Soft Skateboard Wheel | 75 |
| | |
| "Blade Segment" | 29 |
| | |

Ultimate Tensile Strength

Stress vs. Strain curve typical of aluminum.
1 Ultimate Strength
2 Yield Strength
3 Proportional Limit Stress
4 Rupture
5 Offset Strain (usually 0.002)

| Material | Ultimate Tensile Strength [MPa] | Ultimate Tensile Strength [psi] |
|---|---|---|
| Cast Iron | 200 | 29000 |
| Glass | 33 | 4800 |
| PET | 55 | 8000 |
| Rubber | 15 | 2200 |
| HDPE | 15 | 2200 |
| LDPE | 9.7 | 1400 |
| Silicone | 11 | 1600 |
| Silicone | 5-8 | 730-1200 |
| Natural Rubber | 20-30 | 2900-4400 |
| Nitrile Rubber | 10-20 | 1500-2900 |
| | | |
| "Blade Segment" | | 283 |

Figure 12

Ultimate Elongation

Definition: % elongation at break point.

$$Ultimate\ Elongation = \frac{L}{L_0} \times 100$$

$L_0$ is the initial length and L is the length at break point.

| Material | Ultimate Elongation [ % ] |
|---|---|
| Carbon Steel | 5-40 |
| Aluminum | 10-30 |
| Copper | 2-40 |
| Silicone Rubber | 200-800 |
| Butadiene Rubber | 200-400 |
| Natural Rubber | 750-850 |
| Nitrile Rubber | 200-500 |
| PET | 125 |
| HDPE | 500 |
| LDPE | 500 |
| | |
| "Blade Segment" | 365 |

VIBRATION DAMPENING DEVICE AND A CLOSED CHAMBER DEFLECTABLE ACCESSORY FOR A VIBRATION DAMPENING DEVICE

BACKGROUND OF THE INVENTION

The present invention generally relates to a vibration dampening device or capo that can be deployed to damp the strings of a stringed instrument such as a guitar, banjo, or dulcimer, and is especially of value in connection with damping the strings of a stringed instrument comprising a fretted fingerboard; the fingerboard of such instrument is outfitted with a plurality of frets at selected spacings from one another along the fingerboard's length. A vibration dampening device can simultaneously alter the pitch of the entirety of strings along the musical scale or, alternatively, can be configured to only alter the pitch of selected ones of the strings. String instruments create different tones by varying the string thickness, tension and length. On a given instrument, the player may vary the tone on a selected string by pressing the string against a support base (like a fret board on a guitar) and by that action can shorten the length of the string and also change the tone. On some string instruments, a capo is used to create a temporary shortening of all strings to simplify playing in certain keys.

One type of capo—i.e., a vibration dampening device for stringed instruments—has been available commercially and comprises a pressure bar and a neck engaging jaw. The pressure bar of the vibration dampening device is moved into contact with the top of the strings along the fingerboard of the stringed instrument at a location between two successive frets. A clamping force which can optionally be provided as a variable clamping force is applied via a movement of the pressure bar and the neck engaging jaw toward one another and the clamping force is selected or calibrated to cause the pressure bar to press the instrument's strings down against the fingerboard or to press the instrument's strings downwardly toward the fingerboard to an extent that unwanted vibration or "buzzing" of the strings is foreclosed. The instrument's strings are thus downwardly depressed in the extent between the two respective successive frets. One known drawback of a vibration dampening device operated in this manner is that downward displacement of the strings between the two respective successive frets may lead to the stringed instrument being disposed into an "out of tune" condition, due to excessive force, during the clamping operation of the vibration dampening device. This necessitates restoring the instrument to its appropriate tune after installation of the vibration dampening device—that is, the pitch of the strings needs to be adjusted—so that the pitch of the strings is suitable to the user of the stringed instrument.

While the reliability and convenience of a vibration dampening devices for use with stringed musical instruments have been demonstrated, there still remains a need for a vibration dampening devices for use with stringed musical instruments that provides even greater convenience to a user and that reduces the risk that an excessive force will be applied to the stringed instrument.

SUMMARY OF THE INVENTION

It is one object of the present invention is to provide a vibration dampening device or capo that reduces the risk that an excessive force will be applied to a stringed instrument. It is another object of the present invention to provide a closed volume deflectable accessory for a vibration dampening device that reduces the risk that an excessive force will be applied to a stringed instrument.

According to one aspect of the present invention, there is provided a vibration dampening device having a portion in contact with the strings of the stringed instrument that is comprised of silicone rubber formed of polydimethylsiloxane OH-terminated and polydimethylsiloxane Trimethyl-terminated. According to another aspect of the present invention, there is provided a closed volume deflectable accessory for a vibration dampening device is provided and is specifically configurable as a component of a vibration dampening device of the type often called a capo or capo-tasto that is deployed in clamping engagement about the neck and fingerboard of a stringed instrument such as a guitar for the purpose of altering music properties of the stringed instrument. One particular type of capo on which the closed volume deflectable accessory is highly suitable in a capo that includes a portion in contact with the strings of the stringed instrument that is comprised of silicone rubber formed of polydimethylsiloxane OH— terminated and polydimethylsiloxane Trim ethyl-terminated.

BRIEF DESCRIPTION OF THE DRAWINGS

FIGS. 10-12 each depicts a comparison of possible values for a material composition suitable for the second blade segment of the vibration dampening device;

DETAILED DESCRIPTION OF AN EMBODIMENT

Figure 1:
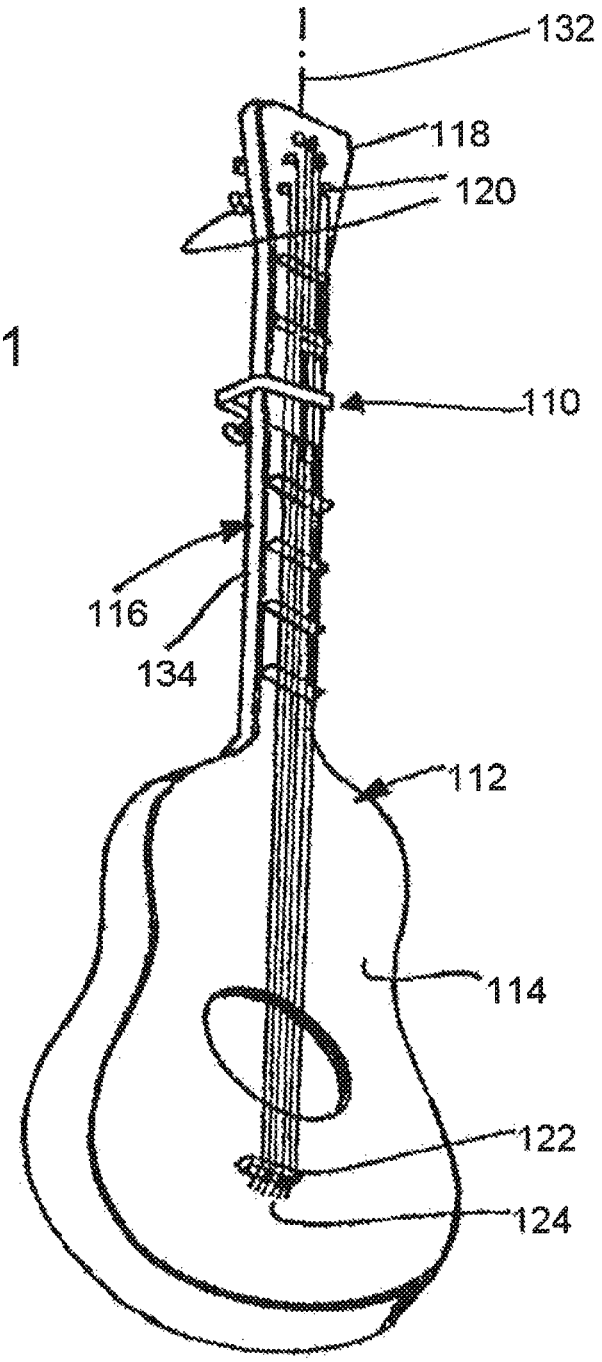
FIG. 1 is a perspective view of a guitar that is representative of the type of stringed instrument on which the vibration dampening device of the present invention can be deployed and showing one embodiment of the vibration dampening device deployed on the guitar.

As seen in FIGS. 1-9, one embodiment of a vibration dampening device generally designated as the vibration dampening device 110 is provided by the present invention for use with a stringed instrument such as, for example, a twelve string guitar 112 shown in FIG. 1. A guitar configuration with twelve strings is a known configuration, as is a guitar configuration with six strings; it is to be understood that the herein provided description of a twelve string guitar is merely for exemplary purposes and the vibration dampening device of the present invention can be deployed on any stringed instrument. A twelve string guitar typically includes some strings of a smaller diameter and the remaining strings of a larger diameter. As seen in FIG. 1, which is a perspective view of the guitar 112 that is to be understood as representative of the type of stringed instrument on which the vibration dampening device of the present invention can be deployed, the guitar 112 has a body portion 114, a fingerboard 116, and a headstock 118. There are a total of twelve (12) strings extending over the fingerboard 116 with each string being secured at a respective one of a plurality of pegs 120 at the headstock 118 and each string extending over a bridge 122 on the body portion 112 whereat the strings are attached to the body portion at a securement location 124.

Figure 7:
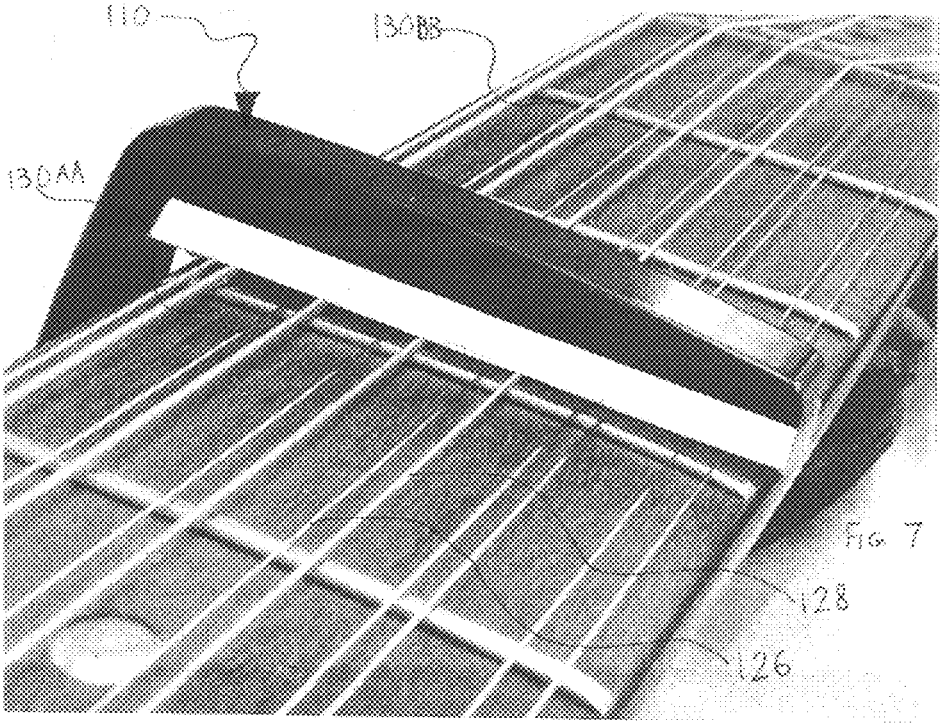
FIG. 7 is an enlarged perspective view of a portion of the guitar on which the vibration dampening device of the present invention is deployed and showing the position of the topside bar of the one embodiment of the vibration dampening device when the vibration dampening device is in the respective non-dampening position shown in FIG. 2.
Figure 8:
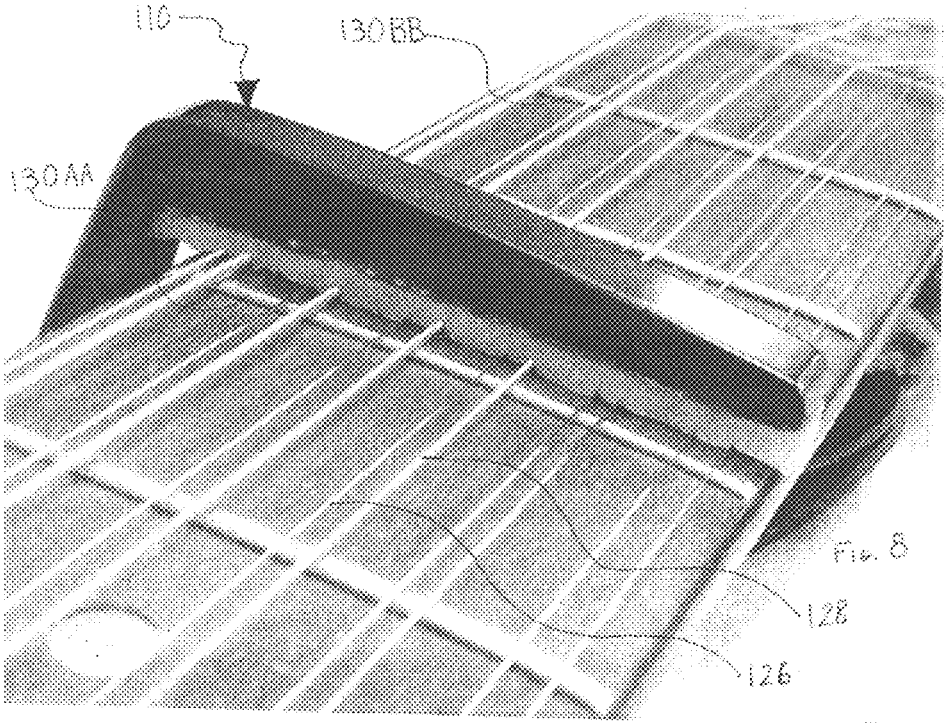
FIG. 8 is an enlarged perspective view of a portion of the guitar on which the vibration dampening device of the present invention is deployed and showing the position of the topside bar of the one embodiment of the vibration dampening device when the vibration dampening device is in the respective dampening position shown in FIG. 6.

As seen in FIG. 7, which is an enlarged perspective view of a portion of the guitar 112 on which the vibration dampening device 110 is deployed and showing a topside bar of the vibration dampening device, the strings of the guitar 112 are comprised of a first sub-group of relatively thinner diameter strings 126 all of a uniform diameter and a second sub-group of relatively larger diameter strings 128 all of a uniform diameter and each of which has a greater diameter than the diameter of a relatively thinner string 126. The strings 126, 128 are configured to cooperate with a plurality of frets 130 which are laid out in accordance with a preference of the user of the guitar 112 for the purpose of shortening or lengthening the lengths of the strings 126, 128, which consequentially alters the musical notes provided by the guitar 112. The frets 130 of the fingerboard 116 are parallel one to the other, and are spaced from another, along the length of the fingerboard 116, and the frets are disposed perpendicular to a longitudinal axis 132 of the fingerboard 116. As shown in FIG. 7, the fingerboard 116 is a planar fingerboard but the fingerboard 116 can alternatively be configured a curved fingerboard having a slight curve downwardly to each lateral side of a longitudinal mid-line. The fingerboard 116, along with the frets 130, forms the top surface of a neck 134 of the guitar 112 that extends from the body portion 114.

Figure 9:
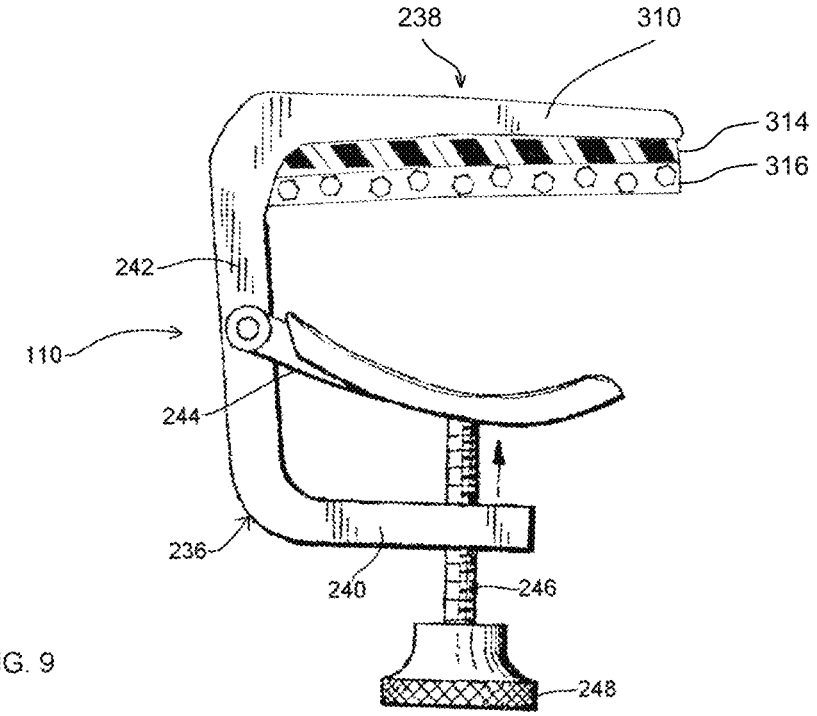
FIG. 9 is a front elevational view of the one embodiment of the vibration dampening device shown in FIG. 1.

As seen in FIG. 9, which is a front elevational view of the vibration dampening device 110, the vibration dampening device 110 comprises a generally C-shaped frame 236 having a topside bar 238 and an underside base 240 that are integrally connected at one end by a liaison strut 242. The topside bar 238 and the underside base 240 are disposed outwardly from the liaison strut 242 in a generally parallel alignment. In order to clampingly engage the vibration dampening device 110 about the neck and fingerboard of a stringed instrument such as the guitar 112, any conventional clamping mechanism may be used and, for exemplary purposes only, the vibration dampening device 110 is shown as having a clamping configuration that comprises a neck engaging jaw 244 pivotally connected along the length of the liaison strut 242 and configured as an arm that extends outwardly from the liaison strut 242 between the topside bar 238 and the underside base 240. The backside or underneath side of the necks of many stringed instruments are curved to conform to the curvature of a person's hand and the neck engaging jaw 244 is arcuately shaped to be in conformity therewith. Further, the neck engaging jaw 244 may be coated with a resilient material or padding along its concave surface so as to buffer the area of contact between the neck engaging jaw 244 and the neck of the instrument.

When the vibration dampening device 110 is deployed on the guitar 112, the neck of the instrument passes between the topside bar 238 and the neck engaging jaw 244. In order to secure the vibration dampening device 110 in a desired position, the lever is forced toward the topside bar 238 and into engagement with the neck of the guitar 112 by advancing an adjusting screw 246. The adjusting screw 246 is threadingly engaged by the underside base 240 and has an adjusting knob 248 adjacent the outer end thereof. The forward end of the adjusting screw 246 is seated against the rear or convex surface of the neck engaging jaw 244.

The topside bar 238 depresses or bows the strings 126A, 128A against the surface of the fingerboard 116 at the string contact location in between two adjacent frets 130AA, 130BB, or depresses the strings 126, 128 to locations slightly spaced above the fingerboard 116 at the string contact location in between two adjacent frets 130AA, 130BB. This bowing of the strings 126,128 causes the strings to stretch tighter due to the installed vibration dampening device 110 which, in turn, causes the pitch of the strings to be correspondingly influenced.

Figure 2:
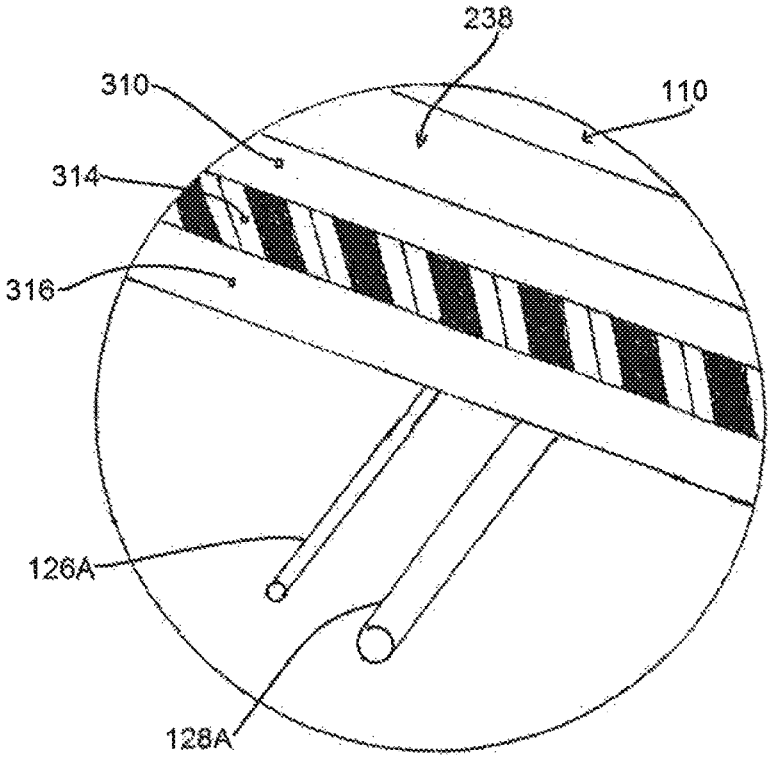
FIGS. 2-6 are each an enlarged perspective view of a portion of the one embodiment of the vibration dampening device shown in FIG. 7 and showing a respective position of the portion of the one embodiment of the vibration dampening device as the one embodiment of the vibration dampening device is moved between a non-dampening position shown in FIG. 2 and a dampening positioned shown in FIG. 6 in which the one embodiment of the vibration dampening device is in contacting with a first sub-group of respective smaller diameter strings and a second sub-group of respective larger diameter strings of a stringed instrument.
Figure 3:
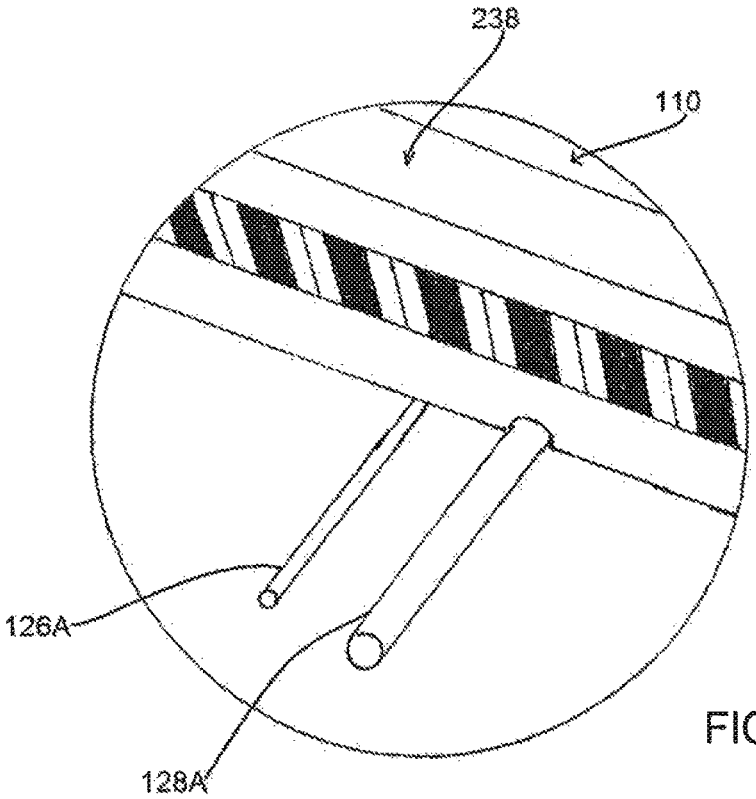

With reference now to FIGS. 2-9, further details of the vibration dampening device 110 and its operation will now be described. As seen in FIG. 2, which is an enlarged perspective view of a portion of the vibration dampening device 110 positioned for contacting a respective smaller diameter string 126A and a respective larger diameter string 128A, the vibration dampening device 110 in its deployed condition is disposed to contact all of the strings 126, 128, including the respective smaller diameter string 126A and the respective larger diameter string 128A, at a string contact location between a respective pair of adjacent frets 130AA, 130BB. FIG. 2 shows the topside bar 238 of the vibration dampening device 110 extending transversely to the longitudinal axis 132 across all of the strings 126, 128 (with only the respective smaller diameter string 126A and the respective larger diameter string 128A being shown for simplicity) with the topside bar 238 not in contact with the strings 126, 128. Although not shown in FIG. 2, the neck engaging jaw 244 (FIG. 9) is preferably seated against the underside of the neck 134 of the guitar 112. If a user now rotates the adjusting screw 246 in a rotation direction that causes the spacing between the topside bar 238 and the neck engaging jaw 244 to be reduced, the topside bar 238 now begins to contact the strings 126,128. As seen in FIG. 3, after some rotation of the adjusting screw 246 of FIG. 9 has been effected, the topside bar 238 has contacted the larger diameter string 128A and has contacted, but not yet been displaced by, the smaller diameter string 126A.

Figure 4:
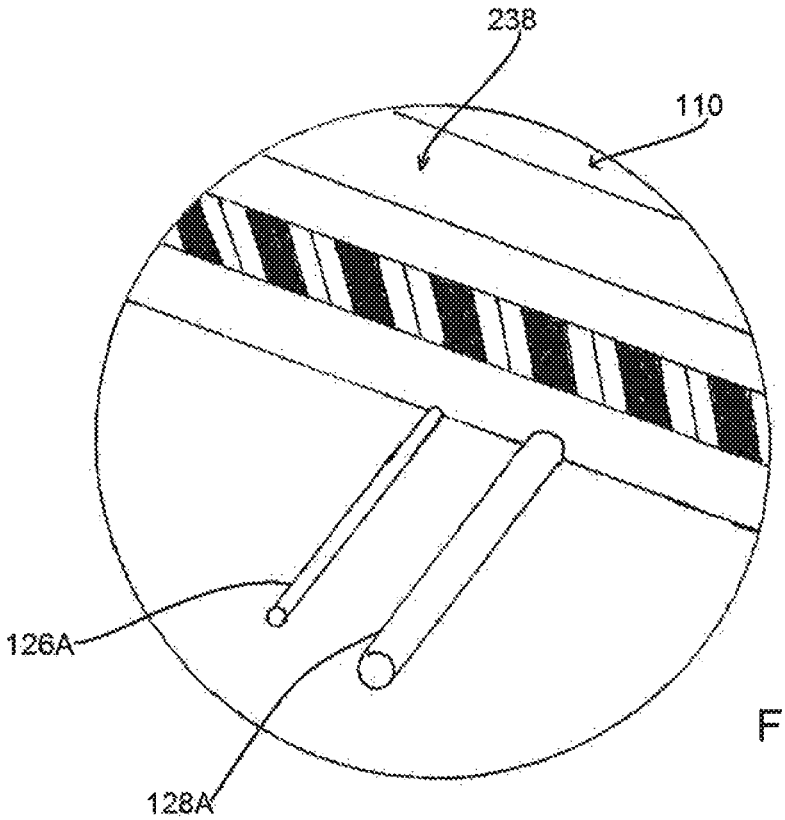
Figure 5:
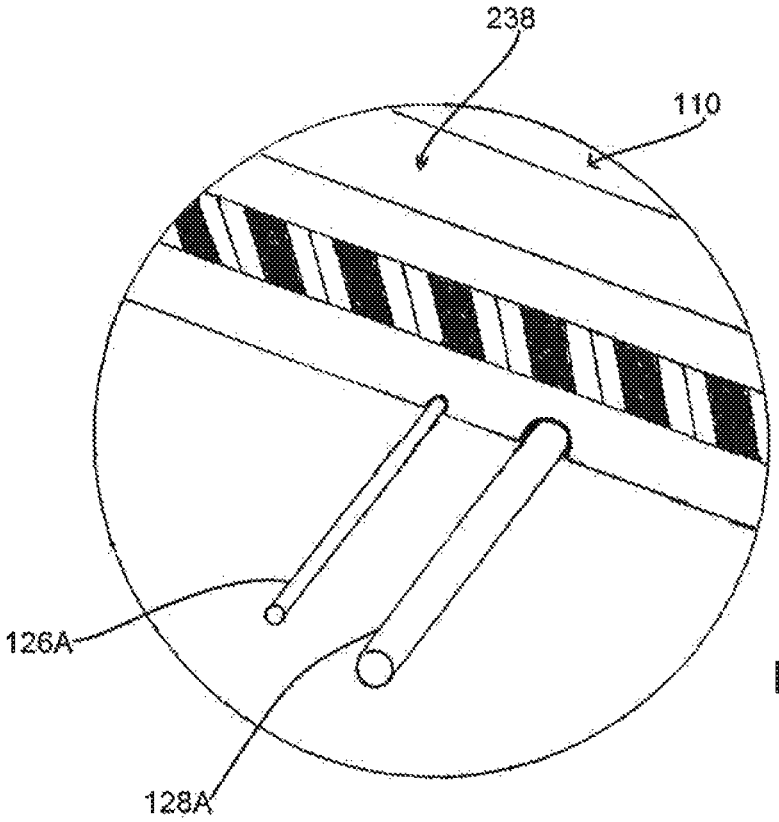
Figure 6:
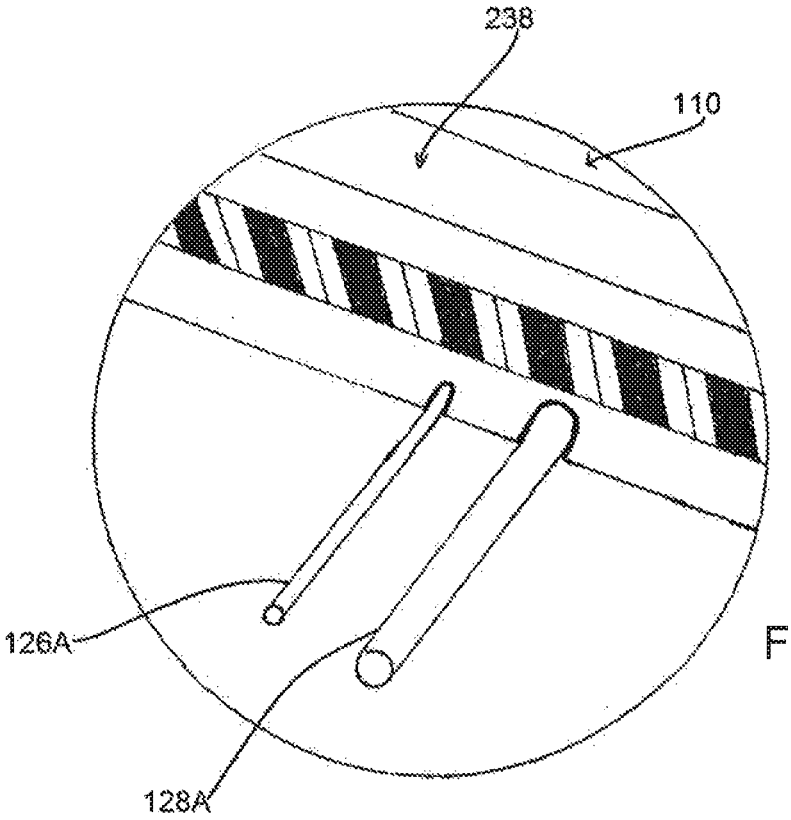

As seen in FIG. 4, further rotation of the adjusting screw 246 of FIG. 9 causes movement of the topside bar 238 relative to the larger diameter string 128A and the smaller diameter string 126A such that the larger diameter string 128A has displaced the topside bar 238 at one location and the smaller diameter string 126A has displaced the topside bar 238 at another location. FIG. 5 illustrates further movement of the topside bar 238 as the spacing between the topside bar 238 and the neck engaging jaw 244 has become reduced, and it can be seen that the larger diameter string 128A has continued to displace the topside bar 238 at the one location and the smaller diameter string 126A has continued to displace the topside bar 238 at the other location. FIG. 6 shows the topside bar 238 at the final selected spacing between the topside bar 238 and the neck engaging jaw 244 at which no further rotation of the adjusting screw 246 is undertaken. In this position of the vibration dampening device 110, the neck engaging jaw 244 is firmly seated against the underside of the neck 134 of the guitar 112 and the topside bar 238 has been engaged by the larger diameter string 128A at the one location and the smaller diameter string 126A at the other location and the strings 126,128 have all been deflected the strings 126A, 128A against the surface of the fingerboard 116 at the string contact location in between two adjacent frets 130AA, 130BB, or have been depressed to locations slightly spaced above the fingerboard 116 at the string contact location in between two adjacent frets 130AA, 130BB. This bowing of the strings 126,128 causes the strings to stretch tighter due to the installed vibration dampening device 110 which, in turn, causes the pitch of the strings to be correspondingly influenced.

With reference again to FIG. 2 and FIG. 9, further details of the topside bar 238 will now be described. The topside bar 238 includes a hollow metal overrider 310 that is connected to the liaison strut 242 and that has four sides and a nose end that together delimit a hollow interior volume. The topside bar 238 also includes a first blade segment 314, designated by alternating thick and thin cross-hatching lines in FIG. 9, and a second blade segment 316, designated by six-sided symbols in FIG. 9. The first blade segment 314 is intermediate the metal overrider 310 and the second blade segment 316 in the sense that the second blade segment 316 is closer to the strings 126,128 in the deployed position of the vibration dampening device 110 than both the metal overrider 310 and the first blade segment 314, the first blade segment 314 is closer to the strings 126,128 in the deployed position of the vibration dampening device 110 than the metal overrider 310 but further from the strings 126,128 in the deployed position of the vibration dampening device 110 than the second blade segment 316, and the metal overrider 310 is further from the strings 126,128 in the deployed position of the vibration dampening device 110 than both the first blade segment 314 and the second blade segment 316. However, the "intermediate" position of the first blade segment 314 is not meant to imply that the first blade segment 314 is fully in contact with either the metal overrider 310 or the second blade segment 316 along the respective facing surfaces nor is the "intermediate" position of the first blade segment 314 meant to imply that the first blade segment 314 is configured to fulfill a specific role in an operational relationship between the metal overrider 310 and the second blade segment 316.

The first blade segment 314 is comprised of a rubber preferably having a durometer as measured by the Shore A hardness scale of greater than 50 and more preferably greater than 60. The first blade segment has a top longitudinal surface that is adhered via suitable adhesive to the bottom underside surface of the metal overrider 310. The top longitudinal surface of the first blade segment 314 is generally co-extensive with the bottom underside surface of the metal overrider 310.

The second blade segment 316 preferably has a durometer as measured by the Shore A hardness scale of less than 50 and more preferably less than 35. The second blade segment has a top longitudinal surface that is adhered via suitable adhesive to the bottom underside surface of the first blade segment or, alternatively, the second blade segment may be secured to the bottom underside surface of the first blade segment via an inherent tackiness of the second blade segment itself. The second blade segment may be comprised of any suitable single material or any suitable combination of individual materials which impart the desired hardness and/or other characteristics that contribute to the suitability of the material for the operation of the second blade segment. In this respect, the modulus of the material—namely, the force required to obtain a certain elongation, which may be measured in pounds per square inch of a cross section of the material—may be evaluated to provide the desired performance of the second blade segment. Likewise, the flexibility of the material—namely, the property of the material to undergo deformation under stress, but not exhibit the ability to stretch and return to its original shape when the stress is relieved—may be evaluated to provide the desired performance of the second blade segment. Similarly, a recovery property of the material—namely, the ability of an elastic material to regain its shape after being deformed, which may be expressed as a percent of the length regained after release from a given elongation—may be evaluated to provide the desired performance of the second blade segment. Also, a fatigue property of a material—namely, the ability of the material to resist the development of cracks or crazes resulting from a large number of deformation cycles,—may be evaluated to provide the desired performance of the second blade segment. As an example of a material that may be suitable for the second blade segment, a gel comprising a relatively highly elastic gelatinous elastomer composition, exhibiting resistance to elastic deformation, and being capable of shape-memory recovery may be selected for use by itself or in combination with other materials. As another example of a material that may be suitable for the second blade segment, the material may be comprised of silicone rubber formed of polydimethylsiloxane OH-terminated and polydimethylsiloxane Trimethyl-terminated.

Figure 11:
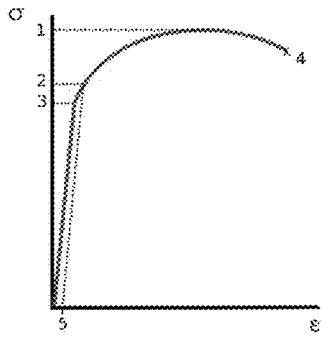

FIGS. 10-12 each depicts a comparison of possible values for a material composition suitable for the second blade segment 316 of the vibration dampening device 110 (this material composition is denominated as "Blade Segment" in the comparisons in FIGS. 10-12) in comparison with other known materials found in various products when evaluated according to a protocol suitable for evaluating Shore A hardness, ultimate elongation, and ultimate tensile strength. The values given in FIGS. 10-12 are not intended to regarded as "average" values for the respective products but are merely given as possible values for the respective products and presentations in FIGS. 10-12 are intended to illustrate the respective property of a material composition suitable for the second blade segment 316 of the vibration dampening device 110 relative to a sampling of other products.

The topside bar 238 can alternatively be configured such that the second blade segment 316, designated by six-sided symbols in FIG. 2, is intermediate the metal overrider 310 and the first blade segment 314 in the sense that the first blade segment 314 is closer to the strings 126,128 in the deployed position of the vibration dampening device 110 than both the metal overrider 310 and the second blade segment 316, the second blade segment 316 is closer to the strings 126,128 in the deployed position of the vibration dampening device 110 than the metal overrider 310 but further from the strings 126,128 in the deployed position of the vibration dampening device 110 than the first blade segment 314, and the metal overrider 310 is further from the strings 126,128 in the deployed position of the vibration dampening device 110 than both the the first blade segment 314 and the second blade segment 316. In this alternative configuration of the topside bar 238, the first blade segment 314 is comprised of a rubber preferably having a durometer as measured by the Shore A hardness scale of greater than 50 and more preferably greater than 60 and the second blade segment 316 preferably has a durometer as measured by the Shore A hardness scale of less than 50 and more preferably less than 35.

Figure 13:
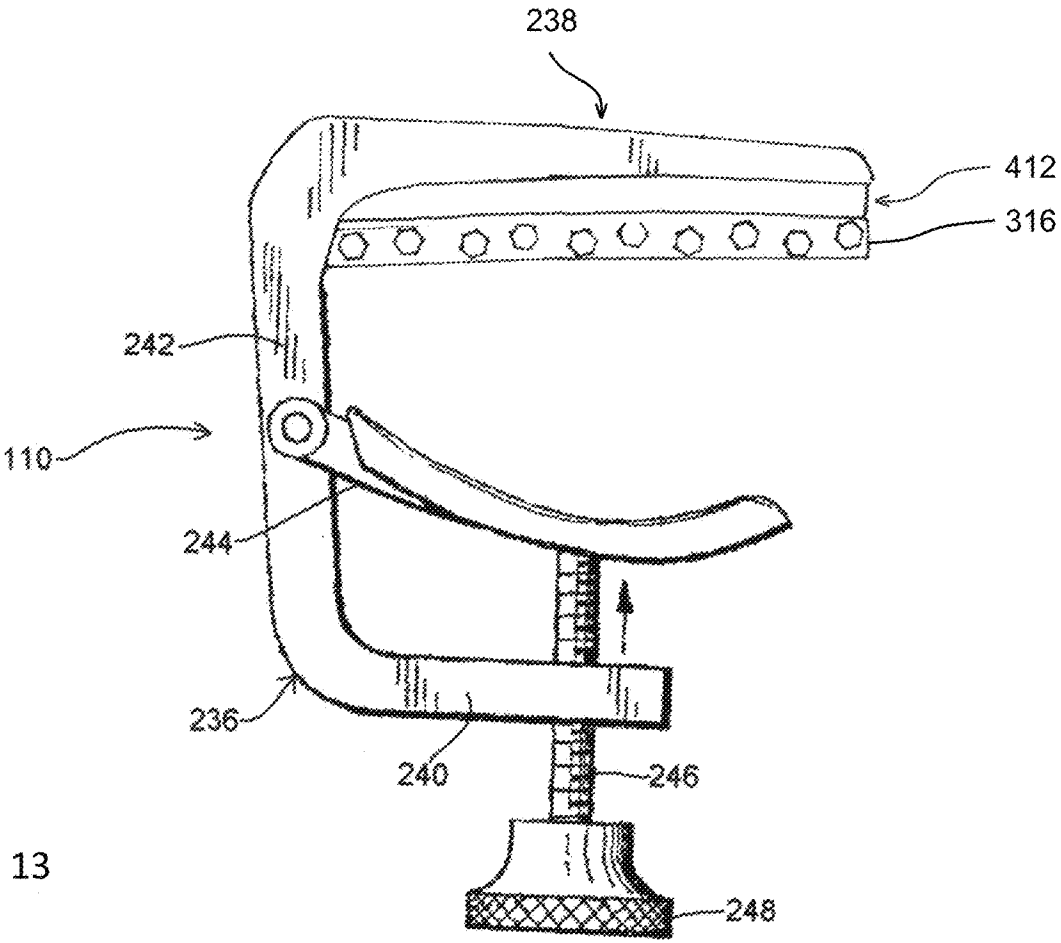
FIG. 13 is a front elevational view of a variation of the vibration dampening device of the present invention.

As seen in FIG. 13, which is a front elevational view of a variation of the vibration dampening device of the present invention, the vibration dampening device in this one variation is provided with a closed volume deflectable accessory in the form of a deflect and return component 412. The vibration dampening device in this configuration does not comprise the first blade segment 314 but, instead, the deflect and return component 412 is provided at the same location at which the first blade segment 314 was located-namely, intermediate the metal overrider 310 and the second blade segment 316 at which the first blade segment 314 is located in the configuration of the vibration dampening device 110 described with respect to FIGS. 1-12. The deflect and return component 412 is comprised of a vessel wall structure 414 (FIG. 17) that delimits a single volume. The volume delimited by the vessel wall structure 414 is fillable with a fluid that may be in the form of a gas, a liquid, a solid, or any combination of a gas, a liquid, and/or a solid. The volume delimited by the vessel wall structure 414 is a closed volume in that the fluid in the volume remains contained within the volume even though the vessel wall structure 414 is subjected to certain forces that cause the vessel wall structure to deflect, so long as the vessel wall structure 414 is not subjected to an integrity comprising force that causes the formation of an aperture in the vessel wall structure through which fluid can leak from or exit from the vessel wall structure 414. It is to be understood that evaporation, transpiration, or other phenomenon that result in a loss of a given fluid component from the volume delimited by the vessel wall structure 414 due to the natural properties of the materials comprised in the vessel wall structure 414 are not considered to be integrity comprising forces.

The vessel wall structure 414 is configured such that it deflects in response to the application thereagainst of a predetermined deflection force. The vessel wall structure 414 may be configured such that it autonomously or with the assistance of other components of the vibration dampening device 110 returns to its non-deflected shape after the application of a predetermined deflection force thereagainst has ceased. Alternatively, the vessel wall structure 414 may be configured to be returned to its non-deflected shape, in response to the actuation of a shape return mechanism (not shown), after the application of a predetermined deflection force thereagainst has ceased.

The closed volume property of the volume delimited by the vessel wall structure 414 is exemplary of one approach for selectively varying the pressure profile of the deflect and return component 412 to respond to certain contact situations of the second blade segment 316 with the strings of the guitar. It is contemplated that the deflect and return component 412 can be deployed such that the vessel wall structure 414 has direct contact with the item or items to be dampened—i.e., the strings of a guitar. Alternatively, the deflect and return component 412 can be deployed such that the vessel wall structure 414 does not have direct contact with the item or items to be dampened and FIG. 13 illustrates one exemplary approach for deploying the deflect and return component 412 such that the vessel wall structure 414 does not have direct contact with the item or items to be dampened. As seen in FIG. 13, the deflect and return component 412 is deployed such that the second blade segment 316, which is shown in FIG. 13 merely for identification purposes as the structure having six-sided symbols thereon, is the component of the vibration dampening device 110 in direct contact with the items to be dampened—the strings of the guitar—while the vessel wall structure 414 has no direct contact with the item or items to be dampened. The deflect and return component 412 has a non-contact pressure profile that obtains when the second blade segment 316 of the deflect and return component 412 is not being deployed to alter the tonal characteristics of a guitar. The deflect and return component 412 selectively transforms from its non-contact pressure profile to a selected one of a group of contact pressure profiles when the second blade segment 316 is deployed to contact the strings of a guitar so as to alter the tonal characteristics of the guitar.

Figure 14:
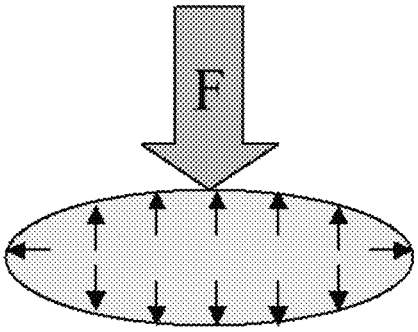
FIGS. 14-16 are schematic illustrations of a fluid filled bladder whose wall is of a uniform thickness and formed of a homogenous material.
Figure 15:
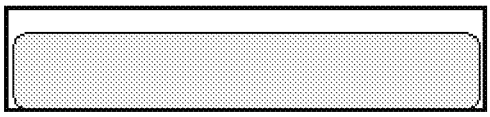
Figure 16:
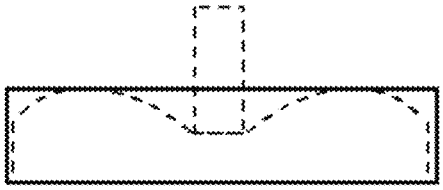

As noted, the capo includes a vessel wall structure that is configured to behave in a manner such that, if a force is applied on one location of the vessel wall structure, the entirety of the vessel wall structure is subjected an uniform increase in pressure. That is, the vessel wall structure 414 and the fluid retained in the volume delimited by the vessel wall structure 414 can be configured such that, if a force is applied on one location of the vessel wall structure, the entirety of the vessel wall structure is subjected an uniform increase in pressure—that is, the pressure is increased on the surfaces of the vessel wall structure equally in all directions and this behavior is illustrated in a schematic manner in FIGS. 14-16. As seen in FIG. 14, which is a schematic illustration of a fluid filled bladder whose wall is of a uniform thickness and formed of a homogenous material, the application of a force on the bladder at one location (schematically represented by a downward arrow exteriorly of the bladder) causes the fluid in the bladder to press outwardly at all locations along the inner surface of the bladder with the same or equal pressure (schematically illustrated by the plurality of outwardly facing arrows shown in the interior of the bladder). As seen in FIG. 15, which is a schematic view of the fluid filled bladder shown in FIG. 14 disposed in a six-sided box, the fluid filled bladder is configured relative to the six-sided box such that the bladder, in its resting position, is in contact with the bottom inner surface of the box and the inner surface of a lower portion of each of the four sidewalls of the box with no gaps between the bladder and the respective inner surface. An air gap exists between the inner surface of the top of the box and the bladder. As seen in FIG. 16, which is a schematic view of the fluid filled bladder shown in FIG. 15 during the application of an external force on the bladder, the application of a force on the bladder at one location (schematically represented by a downward arrow exteriorly of the bladder) causes the bladder to distend into the air gap that existed between the inner surface of the top of the box and the bladder in the resting position of the bladder in the box shown in FIG. 15. This externally applied force will cause an increased pressure on the inner surface of the bladder that is equal in all directions. However, a dimensional change and physical movement is only possible in one direction—namely, the bladder is only free to undergo a dimensional change (a distention) and move in the direction into the air gap that existed between the inner surface of the top of the box and the bladder in the resting position of the bladder in the box shown in FIG. 15. The total force applied downward by the external force onto the bladder has to be balanced with the sum of the forces upwards, which causes the unrestricted top of the bladder to expand upwards. Accordingly, it can be understood that a bladder configured with the properties of the bladder described with respect to FIGS. 14-16 can be highly flexible in that the dimension of the bladder can change but the total force applied can still be distributed over a predetermined extent of the bladder despite the flexibility of the bladder.

Figure 17:
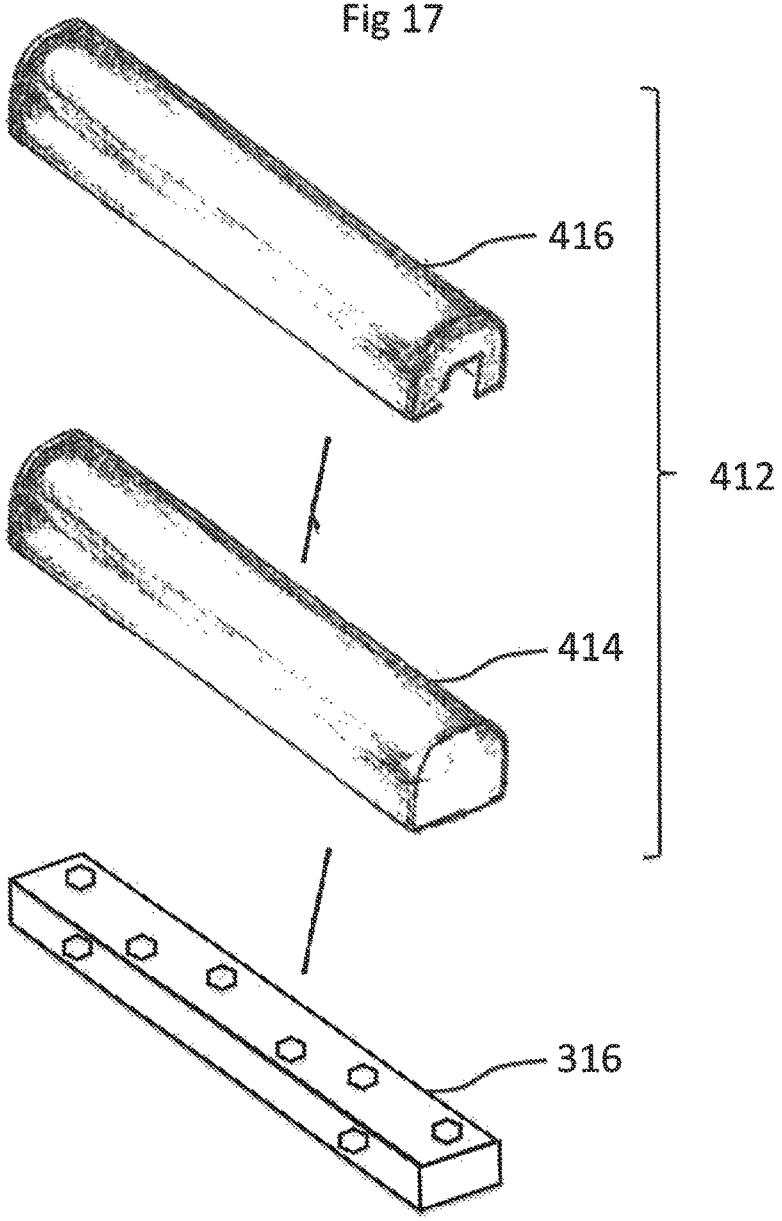
FIG. 17, which is a schematic exploded view of a portion of a version of the vibration dampening device of the present invention.

Reference is now had to FIG. 17, which is a schematic exploded view of a portion of a version of the vibration dampening device 110 of the present invention that is a capo for selectively dampening one or more strings of a guitar. The capo includes the deflect and return component 412 with the vessel wall structure 414 that is configured to behave in a manner such that, if a force is applied on one location of the vessel wall structure 414, the entirety of the vessel wall structure 414 is subjected an uniform increase in pressure. To this end, this deflect and return component 412 shown in FIG. 17 has its volume delimited by the vessel wall structure 414 filled with a substantially incompressible fluid. The vessel wall structure 414 is supported in the restraining housing 416 of a uniform thickness and formed of a homogenous material. The restraining housing 416 allows movement in the vessel wall structure 414 only in one direction—namely, in the direction toward the second blade segment 316. The restraining housing 416 has a top side that is fixedly secured to the topside bar 238, four sidewalls, and an open bottom side. The top side, the four sidewalls, and the open bottom side collectively delimit a volume in which the vessel wall structure 414 is received and the vessel wall structure 414 is retained within this delimited volume via adhesive securement of a portion of the vessel wall structure 414 to the under surface of the top side of the restraining housing. The second blade segment 316 is secured to the vessel wall structure 414 along the underside of the vessel wall structure via adhesive securement. In the configuration shown in FIG. 17, the thickness of the vessel wall structure 414 is preferably in the range of 0.5-20 mm, and most preferably in the range of 1-6 mm and the thickness of the second blade segment 316 is preferably in the range of 0.1-20 mm, and most preferably in the range of 0.1-6 mm.

An example of the manner in which the pressure profile of the deflect and return component 412 selectively varies from its non-contact pressure profile to one of its contact pressure profiles can be seen in connection with the application of a force on the second blade segment 316 by a string generally centrally of the deflect and return component 412 when the vibration dampening device 110 is deployed to after the tonal property of a guitar. This force application results in a reduction in the cross section of the deflect and return component 412 generally laterally centrally and an enlargement of the cross section of the deflect and return component 412 at at least one location spaced from the lateral center of the deflect and return component 412. The enlargement of the cross section of the deflect and return component 412 at at least one location spaced from the lateral center of the deflect and return component 412 varies as a function of the reduction in the cross section of the deflect and return component 412 generally laterally centrally. By virtue of suitable configuration of the deflect and return component 412, the corresponding enlargement of the cross section of the deflect and return component 412 at at least one location spaced from the lateral center of the deflect and return component 412 can be configured such that a desired contact of the vibration dampening device 110 with the strings of the guitar is achieved.

Figure 18:
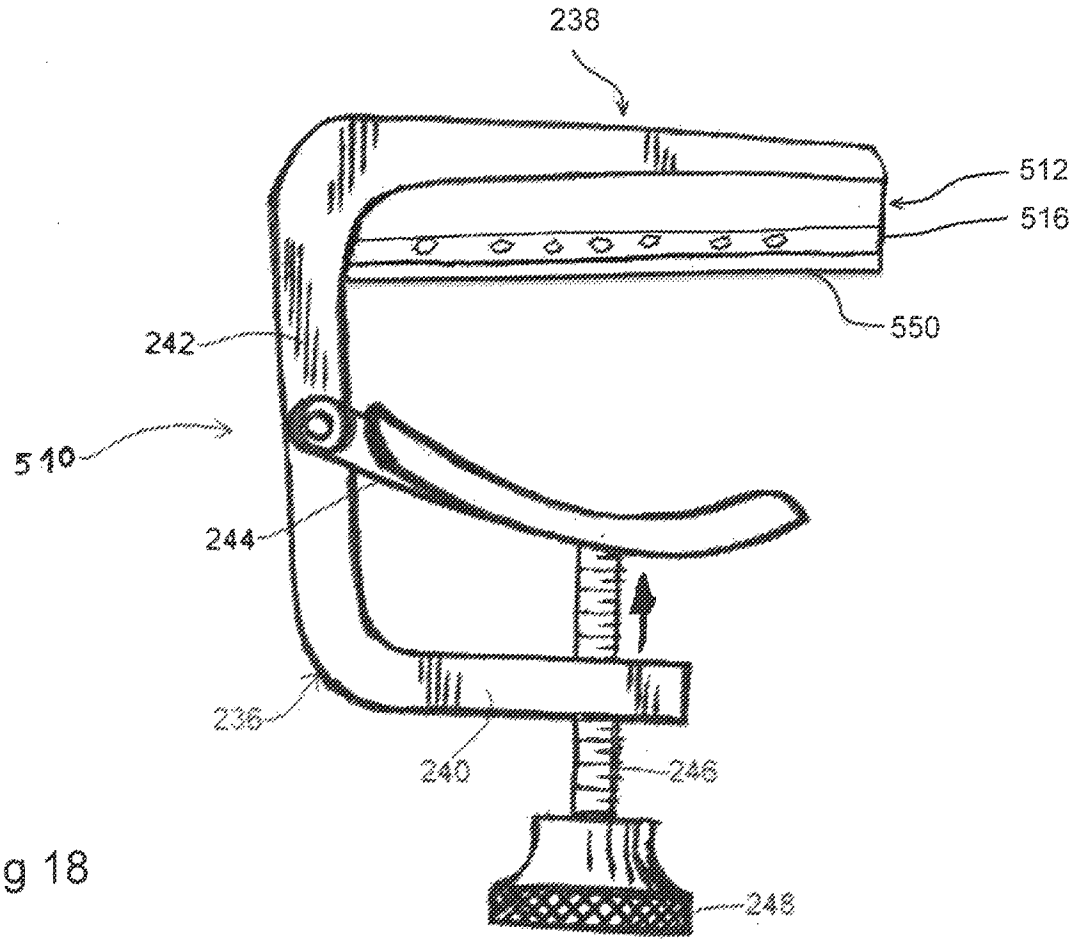
FIG. 18 is a front elevational view of a further variation of the vibration dampening device of the present invention.
Figure 19:
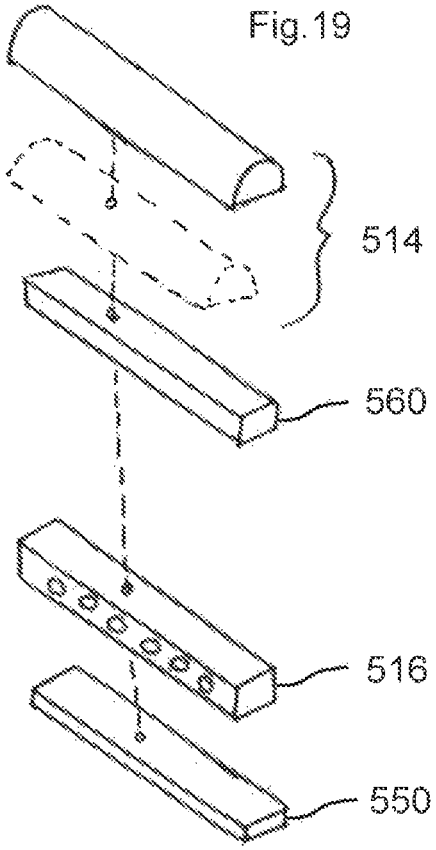
FIG. 19, which is a schematic exploded view of a portion of this further version of the vibration dampening device of the present invention.

Reference is now had to FIGS. 18 and 19 in connection with a description of a further variation of the vibration dampening device of the present invention. As seen in FIG. 18, which is a front elevational view of a further variation of the vibration dampening device of the present invention, and FIG. 19, which is a schematic exploded view of a portion of this further version of the vibration dampening device of the present invention, the vibration dampening device 510 in this further variation is provided with a closed volume deflectable accessory in the form of a deflect and return component 512.

The vibration dampening device 510 in this configuration comprises a second blade segment 516, designated by six-sided symbols in FIG. 19, and a deflect and return component 512. The deflect and return component 512 is located at the same location at which the first blade segment 314 was located as described with respect to the vibration dampening device discussed with respect to FIGS. 1-12 namely, the deflect and return component 512 is intermediate the metal overrider 310 and the second blade segment 516. A first contact skin 550 is disposed on the respective surface of the second blade segment 516 that faces the strings of the stringed instrument, whereupon this first contact skin 550 is intermediate the second blade segment 516 and the strings of the stringed instrument. The first contact skin 550 may be formed, for example, of a polymer, and is secured to the second blade segment 516 via, for example, an adhesive property of the second blade segment 516, the first contact skin 550, and/or another adhesive. The first contact skin 550 is relatively very thin and it is not mandatory that the first contact skin 550 extend in complete overlying relationship over the second blade segment 516—in other words, the first contact skin 550 can have apertures at which a string of a stringed instrument may directly contact the second blade segment 516. The first contact skin 550 is primarily provided to enhance the structural stability and integrity of the second blade segment 516.

The deflect and return component 512 is comprised of a rubber liaison component 560 and a vessel wall structure 514 that delimits a single volume. The volume delimited by the vessel wall structure 514 is fillable with a fluid that may be in the form of a gas, a liquid, a solid, or any combination of a gas, a liquid, and/or a solid. The vessel wall structure 514 is disposed in contact with the second blade segment 516. The rubber liaison component 560 has one surface in contact with the generally C-shaped frame 236 and an opposed surface in contact with the vessel wall structure 514. As viewed in the direction from the strings of a stringed instrument on which the vibration dampening device 510 is disposed toward the generally C-shaped frame 236, it can be seen that the various elements of the vibration dampening device 510 are sequentially arranged in this order: first contact skin 550, the second blade segment 516, the rubber liaison component 560, and the vessel wall structure 514.

The neck engaging jaw 244 of the vibration dampening device 510 of FIG. 18 may be provided with a closed volume deflectable accessory in the form of a deflect and return component that is similarly configured with respect to the deflect and return component 412 of FIG. 17 and this deflect and return component may comprise a vessel wall structure such as the vessel wall structure 414 of FIG. 17 that delimits a single volume. The volume delimited by the vessel wall structure is fillable with a fluid that may be in the form of a gas, a liquid, a solid, or any combination of a gas, a liquid, and/or a solid. If the neck engaging jaw 244 of the vibration dampening device 510 is provided with such a closed volume deflectable accessory, this enhances the capability of the neck engaging jaw 244 to provide a more precise engagement of the area of contact between the neck engaging jaw 244 and the neck of the instrument and possibly reduce the risk of excessive force being applied on the neck of the instrument.

Although this invention has been disclosed and described in its preferred forms with a certain degree of particularity, it is to be realized that the optimum dimensional relationships for the parts of the invention, to include variations in size, materials, shape, form, function and manner of operation, assembly and use, are deemed readily apparent and obvious to one skilled in the art. Additionally, it is understood that the present disclosure of the preferred forms is only by way of example and that numerous changes in the details of operation and in the combination and arrangement of parts may be resorted to without departing from the spirit and scope of the invention as hereinafter claimed.

What is claimed is:

1. A vibration dampening device is provided for engagement with the strings of a stringed instrument, the vibration dampening device comprising:

a vessel wall structure for retaining a fluid, the fluid in the vessel wall structure being operable to vary the unit pressure applied against the vessel wall structure in response to the application of a predetermined force against the vessel wall structure; and an arrangement for selectively positioning the vessel wall structure in a position relative to the stringed instrument at which the vessel wall structure is subjected to the predetermined force.

2. A vibration dampening device is provided for engagement with the strings of a stringed instrument, the vibration dampening device comprising:

a portion in contact with the strings of the stringed instrument that is comprised of silicone rubber formed of polydimethylsiloxane OH-terminated and polydimethylsiloxane Trimethyl-terminated.

3. A capo for a stringed instrument comprising:

a support frame having a topside portion that is disposed in overlying relationship with the strings of a musical instrument when the capo is employed in an operative position on the instrument;

a deflect and return component mounted to the topside portion of the frame and facing the strings of the musical instrument in the operative position of the capo, the deflect and return component including a vessel wall structure comprised of a closed volume filled with a fluid and confined to deflect under pressure in the direction toward the strings in the operative position; and a clamping arrangement coupled to the frame and the deflect and return component for selectively clamping the capo in the operative position and applying pressure to the vessel wall structure of the capo to deflect the vessel wall structure in the direction toward the strings of the instrument.

4. A capo as defined in claim 3 further including a blade segment disposed in a layered arrangement with the deflect and return component and the topside portion of the support frame.

5. A capo as defined in claim 4 wherein the blade segment is disposed in the layered arrangement with the deflect and return component intermediate the blade segment and the topside portion of the support frame.

6. A capo as defined in claim 5 wherein the blade segment is composed of a rubber-like material.

7. A capo as defined in claim 6 further including a contact skin located in the layered arrangement on a side blade segment facing the strings when the capo is clamped in the operative position on the instrument, the contact skin making contact with the strings of the instrument and serving to enhance the structural integrity of the blade segment.

8. A capo as defined in claim 3 wherein the vessel wall structure is housed in and confined in a delimited volume closed on all sides except the side facing the strings of the instrument in the clamping position of the capo to deflect under pressure toward the strings.

9. A capo as defined in claim 3 wherein the deflect and return component includes a restraining housing having a defined volume closed on all sides other than the side facing the strings of the instrument in the clamping position of the capo, and the vessel wall structure is mounted in the restraining housing and substantially fills the defined volume.

10. A capo as defined in claim 3 wherein the topside portion of the support frame includes a hollow overrider with sides defining a hollow interior volume, and the deflect and return component is mounted to the overrider.

11. A capo as defined in claim 3 wherein:

the clamping arrangement includes an engaging jaw pivotally connected to the support frame for clamping the capo in the operative position on a neck of the musical instrument; and another deflect and return component having a vessel wall structure is mounted on the engaging jaw and is positioned on the jaw to deflect under pressure when the capo is positioned in an operative position clamped on the neck of the instrument.

12. A capo as defined in claim 3 wherein the fluid in the vessel wall structure is selected from the group of a gas, a liquid, a solid, and combinations thereof.

13. A capo for mounting on the neck of a stringed musical instrument for adjusting tone comprising:

a frame having a topside portion that in an operative position of the capo overlies the strings and neck of the instrument;

a clamping arrangement connected with the frame and selectively operable to move the capo into and out of a clamping position on the strings and neck of the musical instrument;

a first layer of a flexible material connected with the topside portion of the frame for applying pressure to the strings when the capo is in the clamping position on the neck of the instrument, the first layer having a given flexibility characteristic determined by its composition; and a second layer of a flexible material disposed on the first layer closer to the strings to apply pressure to the strings of the musical instrument in the clamping position of the capo, the second layer having a flexibility characteristic and composition different from the first layer.

14. A capo for mounting on a musical instrument as defined in claim 13 wherein the first and second layers of flexible material are rubber-like materials, and the first layer has a durometer hardness greater than the second layer.

15. A capo for mounting on a musical instrument as defined in claim 14 wherein the first layer of flexible material is a rubber-like material having a durometer hardness greater than 50 measured by the Shore A hardness scale.

16. A capo for mounting on a musical instrument as defined in claim 14 wherein the second layer of flexible material is a rubber-like material having durometer hardness of less than 30 measured by the Shore A hardness scale.

17. A capo for mounting on a musical instrument as defined in claim 13 wherein a third layer of protective skin material is disposed on the second layer of flexible material so as to be interposed between the second layer and the strings of the instrument in the clamping position of the capo.

18. A capo for mounting on a musical instrument as defined in claim 13 wherein the second layer of a rubber-like material is made from a silicone rubber formed of polydimethylsiloxane OH-terminated and polydimethysiloxane trimethyl-terminated.

19. A capo for mounting on the neck of a stringed musical instrument for adjusting tone comprising:

a support frame with a clamping arrangement for clamping the strings of the musical instrument in a clamping position at various locations along the neck of a musical instrument; and a blade segment composed of a rubber-like material secured to the support frame for applying pressure to the strings of the musical instrument in the clamping position of the capo; and a thin, skin layer of protective material positioned on the blade segment so as to be interposed between the blade segment and the strings to enhance the structural stability and integrity of the blade segment.

20. A capo for mounting on the neck of a stringed musical instrument as defined in claim 19 wherein the thin skin layer of protective material is made of a polymer.

* * * * *